US005708357A

United States Patent [19]

Chen

[11] Patent Number: 5,708,357

[45] Date of Patent: Jan. 13, 1998

[54] POWER CIRCUIT FOR ELECTRONIC CONTROLLER

[76] Inventor: Jing-horng Chen, 4th Floor, No. 21, Lane 222, Hu Lin Street, Taipei City, 110, Taiwan

[21] Appl. No.: 704,346

[22] Filed: Aug. 28, 1996

[51] Int. Cl.[6] ..... G05F 1/56

[52] U.S. Cl. ..... 323/282; 363/15

[58] Field of Search ..... 323/222, 282, 323/290; 363/15, 16, 20

[56] References Cited

U.S. PATENT DOCUMENTS

| | | | |
|---|---|---|---|
| 4,153,360 | 5/1979 | Ikenoue et al. | 363/20 |
| 5,119,013 | 6/1992 | Sabroff | 323/267 |
| 5,128,603 | 7/1992 | Wolfel | 323/282 |
| 5,519,599 | 5/1996 | Shinada et al. | 363/21 |

*Primary Examiner*—Matthew V. Nguyen
*Attorney, Agent, or Firm*—Andrus, Sceales, Starke & Sawall

[57] ABSTRACT

A power supply circuit configuration for an electronic controller comprises a current transformer, a first rectification circuit, a voltage drop circuit, a second rectification circuit, a voltage regulator and filter circuit, a control unit and a power switch unit. The electronic controller is connected externally to a pair of power cords and to a load through a power switch unit. The load is connected in series to the primary winding of the current transformer. When the power switch unit is triggered by the controller and the load start operating, the current flowing in the load is equal to the current flow in the primary winding of the current transformer. Then, the DC current is supplied to the control unit from a first electric path consisting of the current transformer, the first rectification circuit and the voltage regulator and filter circuit. When the load is not operating, the control unit is supplied with DC current from a second electric path consisting of the voltage drop circuit, the second rectification circuit, the voltage regulator and filter circuit.

9 Claims, 4 Drawing Sheets

POWER CIRCUIT FOR ELECTRONIC CONTROLLER

FIELD OF THE INVENTION

This invention relates to a power supply circuit configuration for an electronic controller. The invention allows a conventional mechanical switchgear to be directly replaced by an electronic controller without requiring any additional wiring. The power supply circuit of the invention can be directly built into the power supply circuit of an existing electronic controller.

DISCUSSION OF THE PRIOR ART

A conventional switchgear assembly typically is equipped with an AC power connection and an output line connected to a load. Normally, this switchgear can be operated/switched between on and off positions. If an electronic controller is to be installed, a new AC power connection must be wired into the switchgear. Only by this modified arrangement can the controller be completely supplied with power. In the modified controller discussed above, the switchgear must have three conducting wires; two AC power connections and a conducting wire to the load. Wiring a new AC conducting wire to the switchgear which was originally designed to have only two wires is really inconvenient and time-consuming. Furthermore, since new wiring is required, the modification is uneconomical and costly. Accordingly, it is not economically or practically possible to replace the mechanical switchgear by an advanced electronic controller. Additionally, the installation of general controller is very inconvenient both in working cost and wiring.

SUMMARY OF THE INVENTION

It is an object of the invention to provide a power supply circuit configuration wherein the electronic controller can be directly installed into a conventional mechanical switchgear. The problem of supplying power to the controller is readily solved without the need for new power cords. The controller can be built into the existing mechanical switchgear with the originally designed power cords and load cord. Once connected, the controller can properly perform the predetermined functions of automatic monitoring or detecting of equipment. Additionally, the controller can control multiple loads simultaneously and feed back the sensed result from the controller to a master station, which can perform the direct monitoring. In light of this, the present invention is a novel, practical and excellent invention which is useful in the industry. The invention provides a milestone in the ability to upgrade mechanical switchgears for the industry as well as in daily lives. By the use of the invention, inefficient control to the loads, which leads to a waste of energy, can be solved. Accordingly, by the provision of the power supply circuit configuration, the load can be efficiently controlled and the energy is consequently saved.

In order to achieve the objects set forth, the power supply circuit configuration for an electronic controller made according to this invention comprises a current transformer, a first rectification circuit, a voltage drop circuit, a second rectification circuit, a voltage regulator and filter circuit, a control unit, and a power switch unit.

The voltage drop circuit of this invention can be a transformer voltage drop circuit, a capacitor and resistor voltage drop circuit, or a resistance voltage drop circuit. The power switch can be a triac, a relay or a phototriac coupler. The current transformer can be replaced by a transformer booster or other transformer. The controller of the invention is connected to a power supply cord and a plurality of loads cords. The opposite end of the load is connected to an AC power cord. The primary winding of the current transformer is connected to the load in series through a power switch. The core of the current transformer is preferably made from a high magnetic material. The primary winding of the transformer is configured to sustain higher current, and accordingly it has fewer turns than the secondary winding which sustains lower current. When the load is not operating, the DC current to the controller is provided by an electric path from the AC power cord connected to the load through the voltage dropcircuit, the second rectification circuit and the voltage regulator and filter circuit. In this case, the amperage of the current which flows over the primary winding of the current transformer is relatively small to conserve energy.

When the load is driven by the controller to operate by triggering the power switch, the voltage of the voltage drop circuit is too low to supply DC current required by the controller through the electric path previously described. In this case, the DC current is supplied to the controller from the AC power cord connected to the primary winding of the current transformer via the secondary winding of the current transformer, the first rectification circuit, and voltage regulator and filter circuit.

In this manner, DC current is supplied to the controller by a pair of electric power supply paths, depending on the operating state of the load. When the load is operational, power is supplied through the current transformer. When the load is not operational, power is supplied through the load, which saves power. The pair of power supply paths do not require any additional wiring to be added to the mechanical switchgear.

BRIEF DESCRIPTION OF THE DRAWINGS

The foregoing objects and advantages of the present invention for the power supply circuit configuration for an electronic controller may be more readily understood by one skilled in the art with reference to the following detailed description of a preferred embodiment, taken in conjunction with the accompanying drawings wherein like elements are designated by identical reference numerals throughout the several views, and in which.

DETAILED DESCRIPTION OF THE PREFERRED EMBODIMENT

Figure 1:
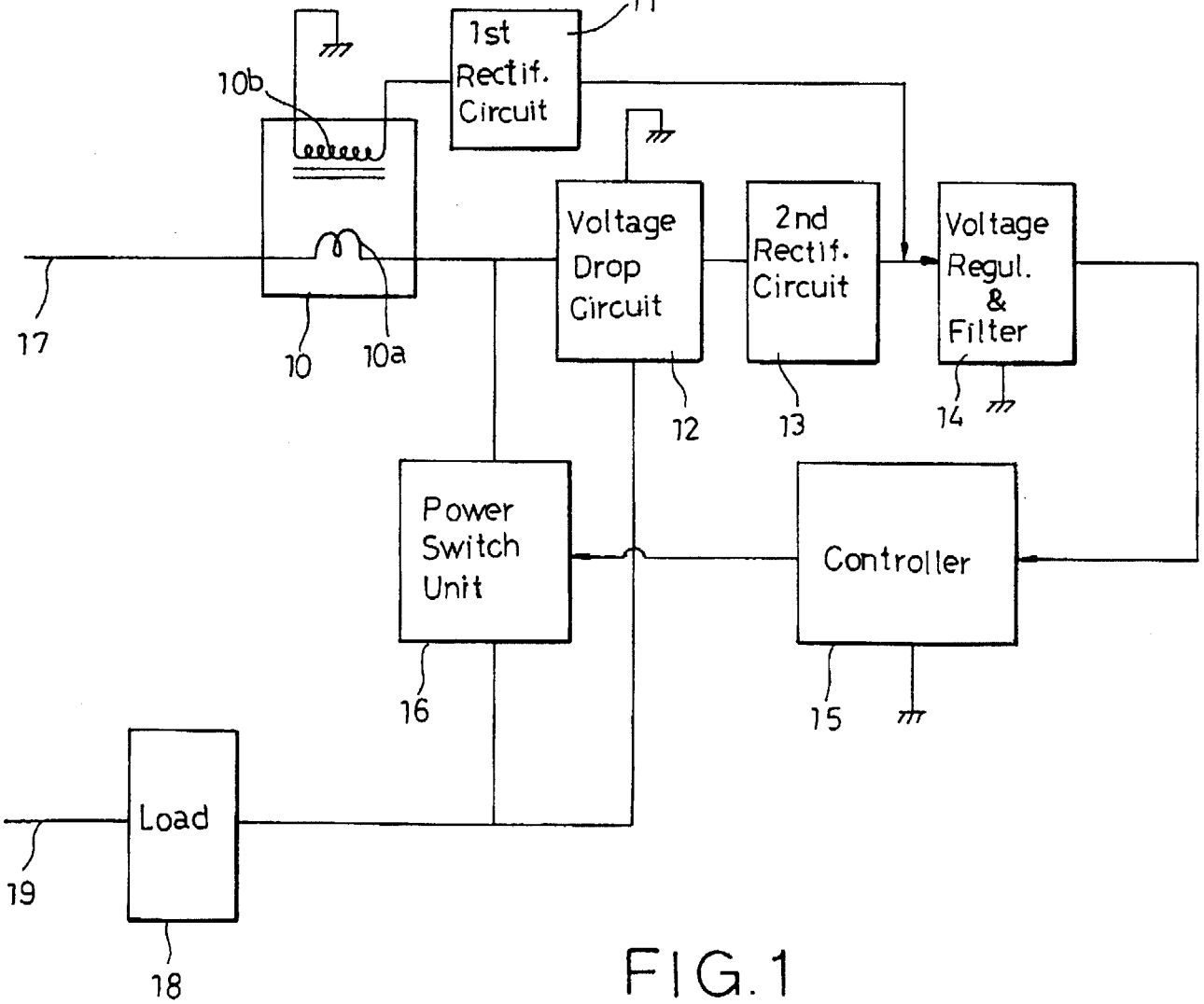
FIG. 1 is a block diagram illustrating the power supply circuit configuration for the electronic controller made according to the invention.

Referring to FIG. 1, the power supply circuit configuration for the electronic controller made according to this invention is shown in block diagram form and comprises a current transformer 10, a first rectification circuit 11, a voltage drop circuit 12, a second rectification circuit 13, a voltage regulator and filter circuit 14, a control unit 15, and a power switch unit 16. One end of the primary winding 10*a* of the current transformer 10 is connected to an AC power cord 17 while the second end of the primary winding 10*a* is connected to a load 18 in series through the power switch unit 16. The other end of the load 18 is connected to another AC power cord 19.

Figure 2:
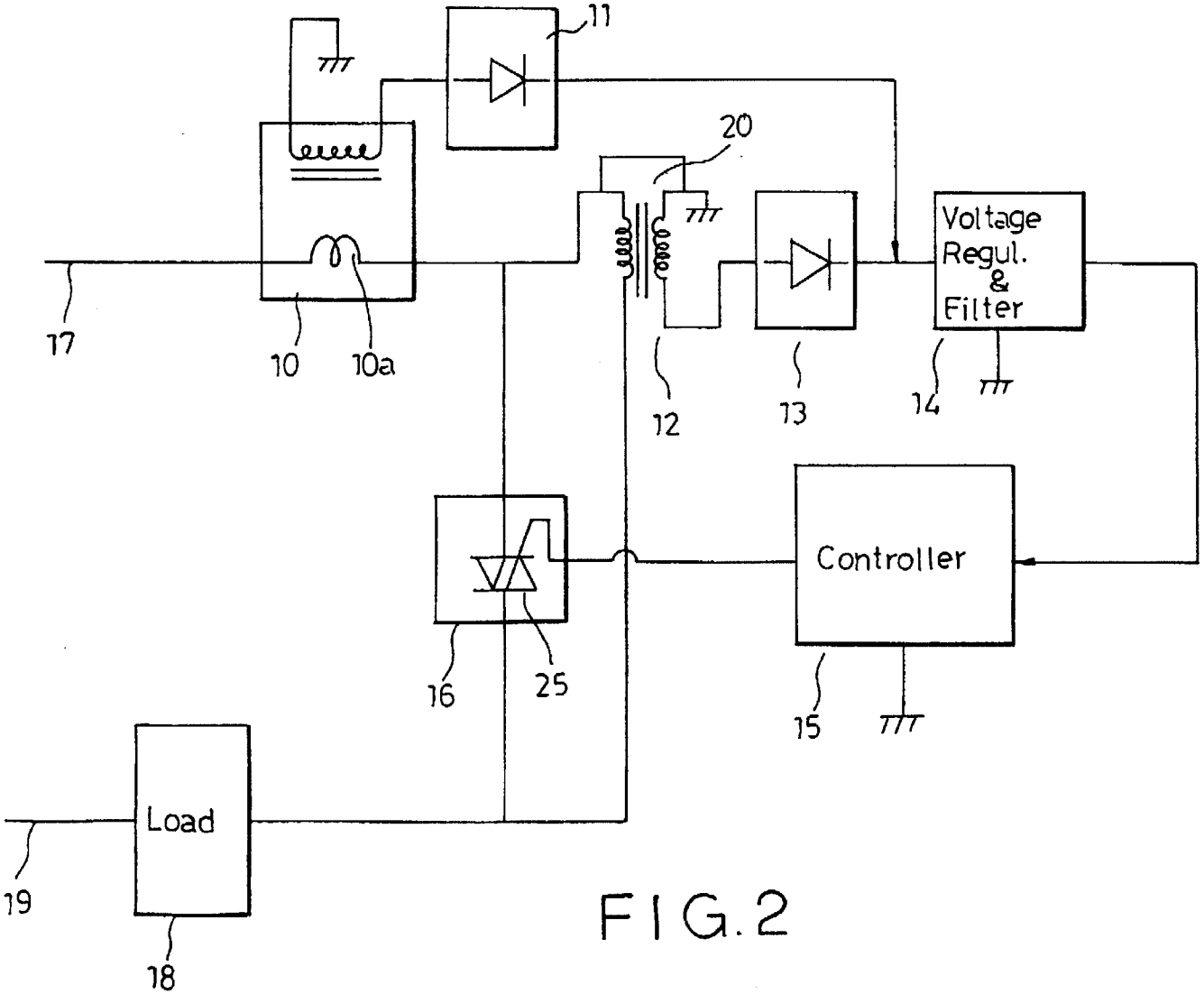
FIG. 2 is similar to FIG. 1, showing an expanded block diagram of the power supply circuit configuration for the electronic controller made according to the invention.

Referring to FIG. 2, there shown is an embodiment of the electronic controlled power supply circuit configuration which uses a transformer 20 as the voltage drop circuit 12. When the current which flows through the primary winding 10*a* of the current transformer 10 and load 18 is relatively low, i.e. the load 18 is not operating, the control unit 15 is supplied with DC current from AC power cord 19 via the transformer 20, the second rectification circuit 13 and the voltage regulator and filter circuit 14.

When the power switch unit 16, in this case triac 25, is triggered by the control unit 15, the voltage across the transformer 10 is almost equal to zero, which allows the load 18 to start to operate. As the load 18 starts to operate, a large amount of current flows through the primary winding of the current transformer 10. At this time, the control unit 15 is supplied with DC current from the AC power cord 17 directly via the current transformer 10, the first rectification circuit 11 and the voltage regulator and filter circuit 14. By this arrangement, the control unit 15 is continuously supplied with sufficient current for detecting, controlling and displaying etc.

Figure 3:
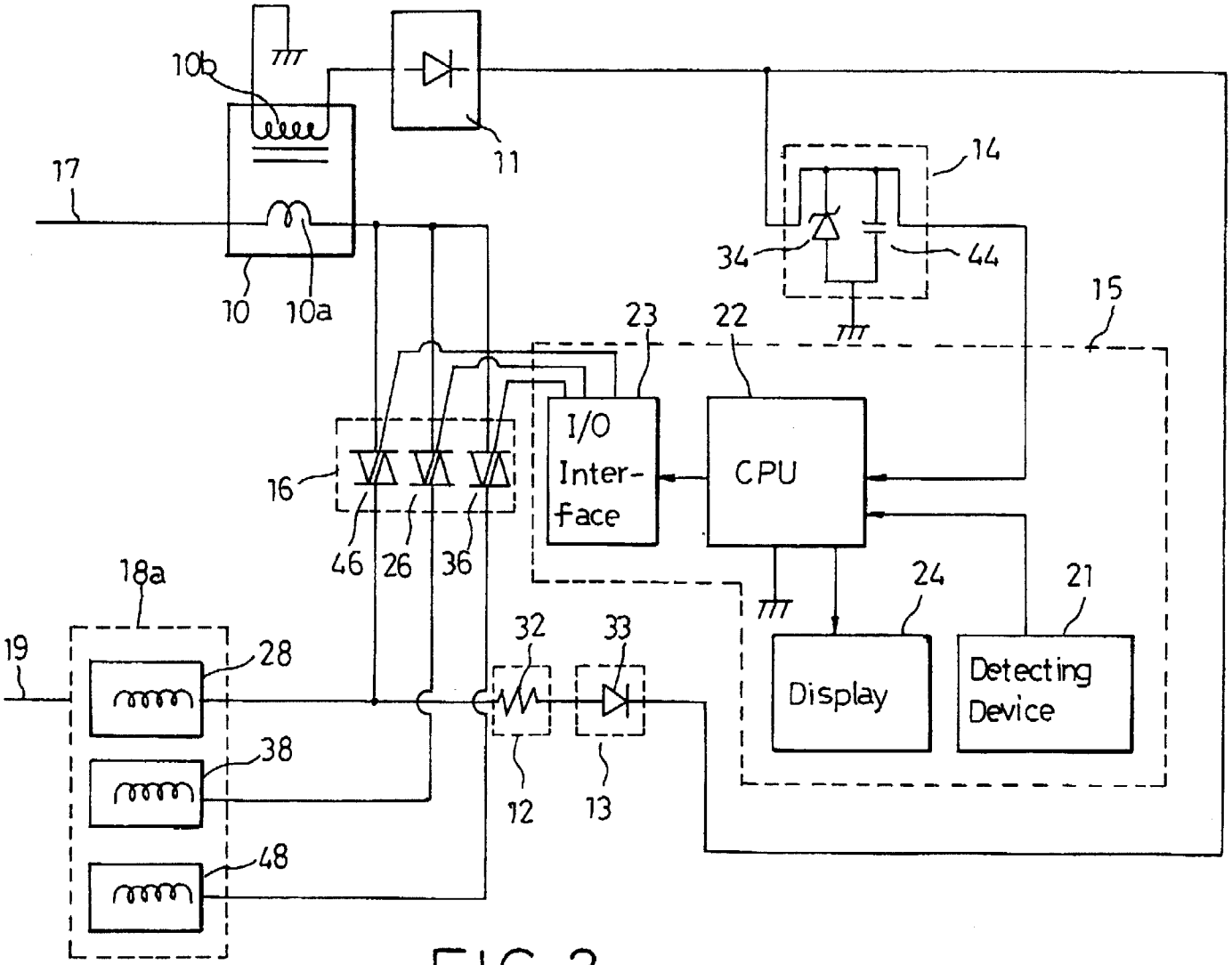
FIG. 3 is a block diagram showing the power supply incorporating a plurality of triacs and a tap-field motor controlled by the present invention.

FIG. 3 is an exemplary embodiment showing a plurality of triacs as the power switch 16 and a tap-field motor 18*a* which is controlled by the present invention. When the motor 18*a* is not in operation, the DC current is supplied to the control unit 15 from the AC power cord 19 through the motor 18*a*, resistance voltage drop circuit 12 (resistor 32), the second rectification circuit 13 (diode 33) and the voltage regulator and filter circuit 14 which is comprised of zener diode 34 and capacitor 44. The control unit 15 includes an interconnected detecting device 21, a CPU 22, an input-output interface 23, and a display 24. The power switch unit 16 is controlled by the input-output interface 23. The power switch unit 16 includes a plurality of triacs 26, 36 and 46. The triac 46 is used to control the low speed winding 28 of the motor 18*a*. The triac 26 is used to control the middle speed winding 38 of the motor 18*a* and triac 36 is used to control the high speed winding 48 of the motor 18*a*.

When the motor 18*a* is not in operation, the DC current is supplied to control unit 15 directly from the resistance voltage drop circuit 12, the second rectification circuit 13 and the voltage regulator and filter circuit 14. When the motor 18*a* is required to operate at low speed, the control unit 15 will trigger the triac 46 which supplies current to the low speed winding 28 of the motor 18*a* to begin motor operation. In this stage, the DC current is generated and supplied to the control unit 15 from the current transformer 10, the first rectification circuit 11 and the voltage regulator and filter circuit 14. When the motor 18*a* is operated at high speed, the triac 36 is triggered and the high speed winding 48 of the motor 18*a* starts operating. Meanwhile, the triac 46 is not triggered, and thus the low speed winding of the motor is not operated.

Figure 4:
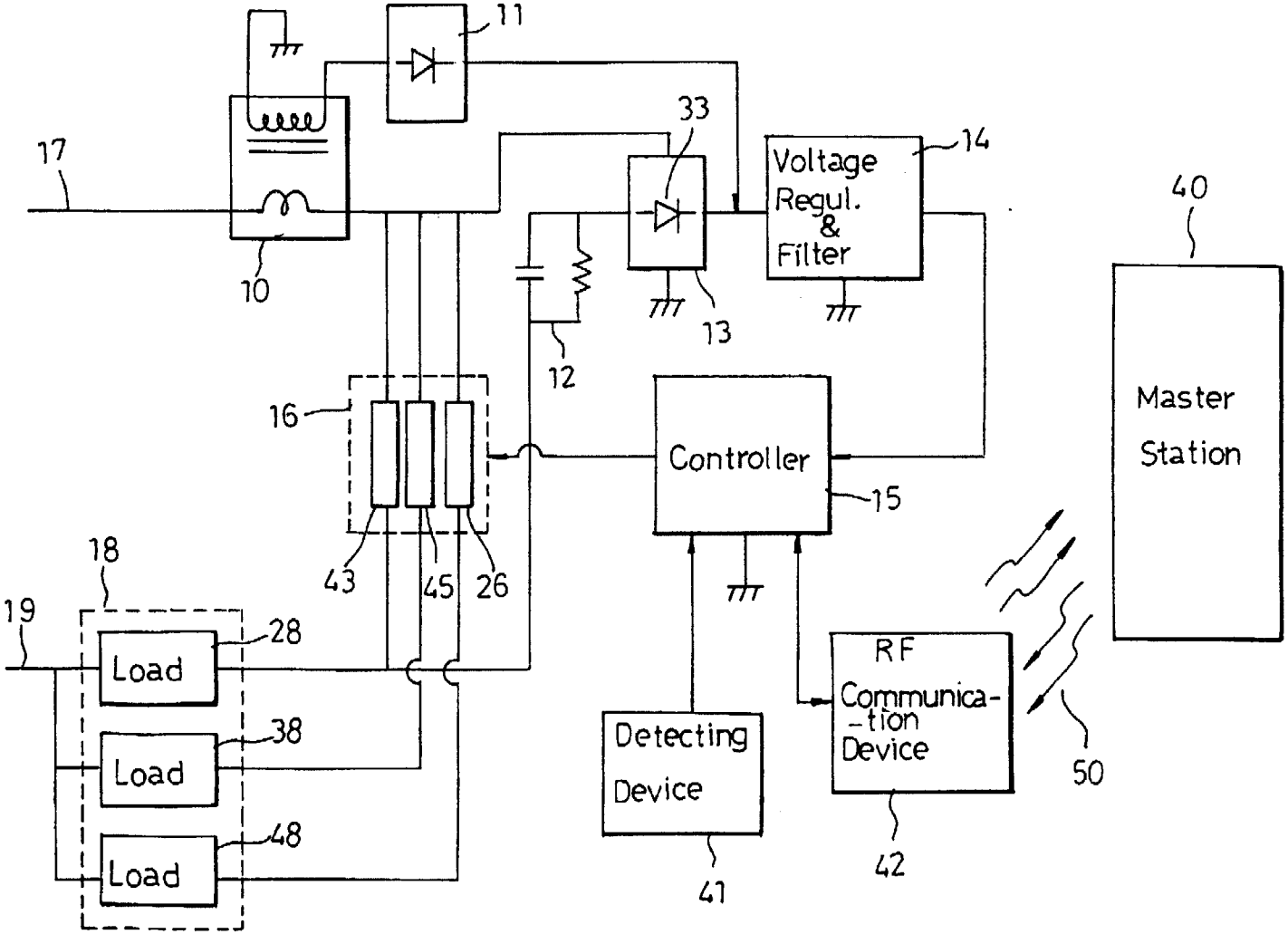
FIG. 4 is an embodiment showing the present invention as used in monitoring, the load being driven by different power switch units and a RF signal transmitted between the master station and the present invention.

Referring to FIG. 4, the present invention is shown used as a monitor and includes different types of power switch units 16 which are used to drive the load 18. Additionally, the power supply circuit can communicate with a master station 40 via an RF signal 50 by means of an RF communication device 42. The control unit may also be connected with a detecting device 41 for other parameters such as temperate, humidity, etc. When the load 18 is not operating, DC current is supplied to the control unit 15 from AC power cord 19 via voltage drop circuit 12, the second rectification circuit 13 and the voltage regulator and filter circuit 14. When the load 18 operates, the control unit 15 is supplied with DC current from AC power cord 17 via the current transformer 10, the first rectification circuit 11 and the voltage regulator and filter circuit 14. In this embodiment, the loads 28, 38 and 48 are driven via different devices in the power switch unit 16. Accordingly, the control unit 15 can be used to drive a relay 43 or a phototriac coupler 45 which can be used to replace the triacs and operate in the identical manner.

When a plurality of loads are all driven simultaneously, the current flow through the primary winding of the current transformer 10 increases, resulting in the current in the secondary winding 10*b* of the current transformer increasing the power supplied to control unit 15 via the first rectification circuit 11 and voltage regulator and filter circuit 14. When more and more power switch units 16 are triggered by the control unit 15 simultaneously, more power consumption is required. In this embodiment, the current transformer 10 can still supply sufficient power to the control unit 15.

In this embodiment, the RF signal 50 is used to communicate between the controller and the master station 40. By this arrangement, the master station 40 can perform the detecting and/or the controlling and/or displaying via monitoring the controller 15. Since the controller can be readily mounted to the conventional switchgear and the data transmission to the master station 40 can be readily performed by the communicating interface 42 built into the controller. Consequently, the automation and monitoring to the factory and the office can be readily done.

By the teaching of the present invention, the conventional problem of converting a mechanical switchgear to an electronic controller can be readily solved by the power supply circuit configuration of the invention. The existing technical problems are solved also. It is understood that different modifications and variations can be readily made by someone skilled in the art without departing the spirit and scope of the present invention. For example, the position of the primary winding of the current transformer 10 could be moved to another position and connected to the triac or other power switch unit 16 in series, and still fall into the appended claims.

I claim:

1. A power supply circuit configuration for electronically controlling the energization of a load connected in series with a pair of power mains, said power supply circuit configuration, comprising:

an electronic control unit;

a first electric path comprising;

a current transformer having a primary winding and a secondary winding, said primary winding being connected in one of said power mains, a first rectification circuit connected to the secondary winding of the current transformer, and a voltage regulator and filter circuit connected between the first rectification circuit and said control unit;

a second electric path comprising;

a voltage drop circuit connected to the load, and a second rectification circuit connected between the voltage drop circuit and the voltage regulator and filter circuit; and a power switch unit connected in series with the load and between the current transformer and the load, the power switch unit being in communication with the control unit to selectively supply power to the load, wherein when the power switch unit is operated by the control unit to energize the load, the control unit is supplied with current by the first electric path and when the power switch unit is operated by the control unit to de-energize the load, the control unit is supplied with current by the second electric path.

2. A power supply circuit configuration as recited in claim 1, wherein the primary winding of the current transformer is connected in series with both the load and the power switch unit.

3. A power circuit configuration as recited in claim 1, wherein the voltage drop circuit is a transformer voltage drop circuit.

4. A power circuit configuration as recited in claim 1, wherein the voltage drop circuit is a capacitor voltage drop circuit.

5. A power circuit configuration as recited in claim 1, wherein the voltage drop circuit is a resistance voltage drop circuit.

6. A power circuit configuration as recited in claim 1, wherein the power switch unit includes one or more triacs.

7. A power circuit configuration as recited in claim 1, wherein the power switch unit includes a relay.

8. A power circuit configuration as recited in claim 1, wherein the power switch unit includes a photo-triac coupler.

9. A power circuit configuration as recited in claim 1, wherein the current transformer is a transformer booster.

* * * * *